US011313018B2

(12) United States Patent
Lee et al.

(10) Patent No.: US 11,313,018 B2
(45) Date of Patent: Apr. 26, 2022

(54) TRANSFORMATION-INDUCED PLASTICITY HIGH-ENTROPY ALLOY AND PREPARATION METHOD THEREOF

(71) Applicant: POSTECH ACADEMY—INDUSTRY FOUNDATION, Pohang-si (KR)

(72) Inventors: Byeong-joo Lee, Pohang-si (KR); Sung-hak Lee, Pohang-si (KR); Seok-su Sohn, Ulsan (KR); Hyoung-seop Kim, Pohang-si (KR); Dong-geun Kim, Pohang-si (KR); Yong-hee Jo, Daegu (KR); Won-mi Choi, Pohang-si (KR)

(73) Assignee: POSTECH ACADEMY-INDUSTRY FOUNDATION, Pohang-si (KR)

( * ) Notice: Subject to any disclaimer, the term of this patent is extended or adjusted under 35 U.S.C. 154(b) by 16 days.

(21) Appl. No.: 16/310,545

(22) PCT Filed: Mar. 30, 2018

(86) PCT No.: PCT/KR2018/003772

§ 371 (c)(1),
(2) Date: Dec. 17, 2018

(87) PCT Pub. No.: WO2019/083103

PCT Pub. Date: May 2, 2019

(65) Prior Publication Data

US 2021/0269900 A1 Sep. 2, 2021

(30) Foreign Application Priority Data

Oct. 25, 2017 (KR) ..... 10-2017-0139052
Jan. 19, 2018 (KR) ..... 10-2018-0006851

(51) Int. Cl.
*C22C 30/00* (2006.01)
*C22F 1/16* (2006.01)

(52) U.S. Cl.
CPC ..... *C22C 30/00* (2013.01); *C22F 1/16* (2013.01)

(58) Field of Classification Search
CPC ..... C22C 30/00; C22F 1/16
See application file for complete search history.

(56) References Cited

U.S. PATENT DOCUMENTS 4,171,978 A 10/1979 Inoue
2002/0159914 A1 10/2002 Yeh
(Continued)

FOREIGN PATENT DOCUMENTS

JP 2016-023352 2/2016
KR 10-2017-0106016 9/2017
(Continued)

OTHER PUBLICATIONS

Y.H. Jo et al., "Cryogenic strength improvement by utilizing room-temperature deformation twinning in a partially recrystallized VCrMnFeCoNi high-entropy alloy", Nature Communications, 8:15719, Jun. 12, 2017, DOI: 10.1038/ncomms15719.
(Continued)

*Primary Examiner* — John A Hevey
(74) *Attorney, Agent, or Firm* — Lex IP Meister, PLLC

(57) ABSTRACT

Present invention is about a transformation-induced plasticity high-entropy alloy which can provide improved mechanical properties compared to those obtained by conventional methods, due to the phase transformation occurring at the time of deformation at a cryogenic temperature. According to the present invention, the high-entropy alloy (HEA) includes 10-35 at % of Co, 3-15 at % of Cr, 3-15 at % of V, 35-48 at % of Fe, and 0-25 at % of Ni (exclusive of 25), and mainly consists of an FCC phase at room temperature, wherein transformation-induced plasticity, in which at
(Continued)

least part of the FCC phase changes to a BCC phase, occurs at a cryogenic temperature (−196° C.)

9 Claims, 11 Drawing Sheets

(56) References Cited

U.S. PATENT DOCUMENTS

| | | | | |
|---|---|---|---|---|
| 2017/0233855 | A1* | 8/2017 | Park | C22C 38/06 420/44 |
| 2019/0071755 | A1* | 3/2019 | Lee | C22C 38/58 |

FOREIGN PATENT DOCUMENTS

| | | |
|---|---|---|
| KR | 10-2017-0110018 | 10/2017 |
| KR | 20170110018 | 10/2017 |

OTHER PUBLICATIONS

EPO, Search Report of EP 18814482.8 dated Aug. 6, 2021.

* cited by examiner

【FIG.1】
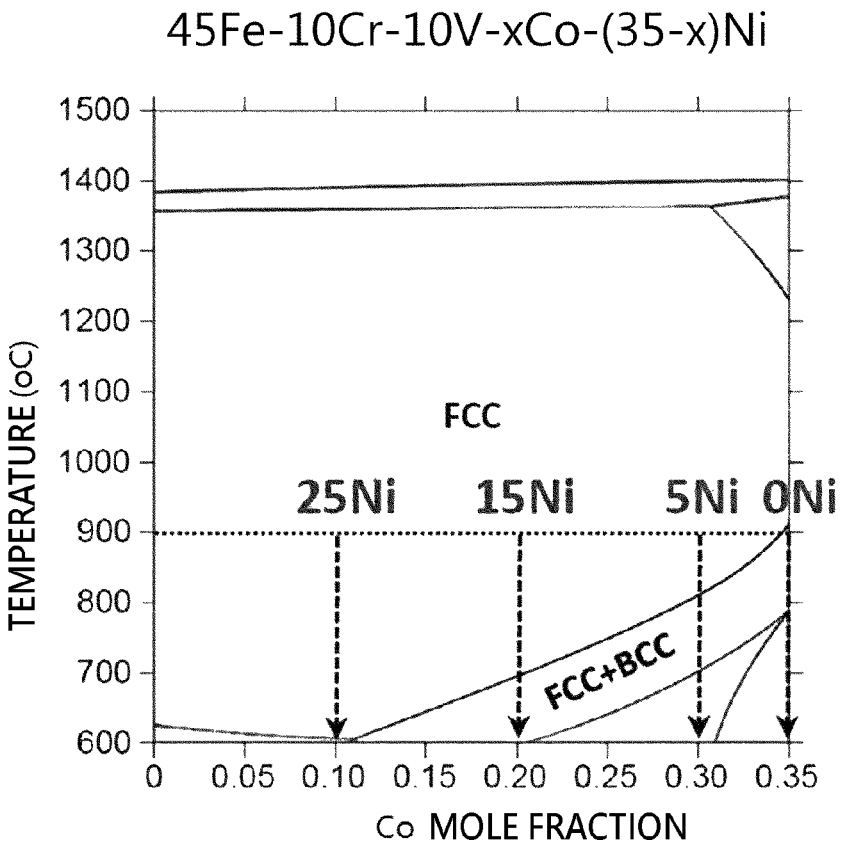

【FIG.2】
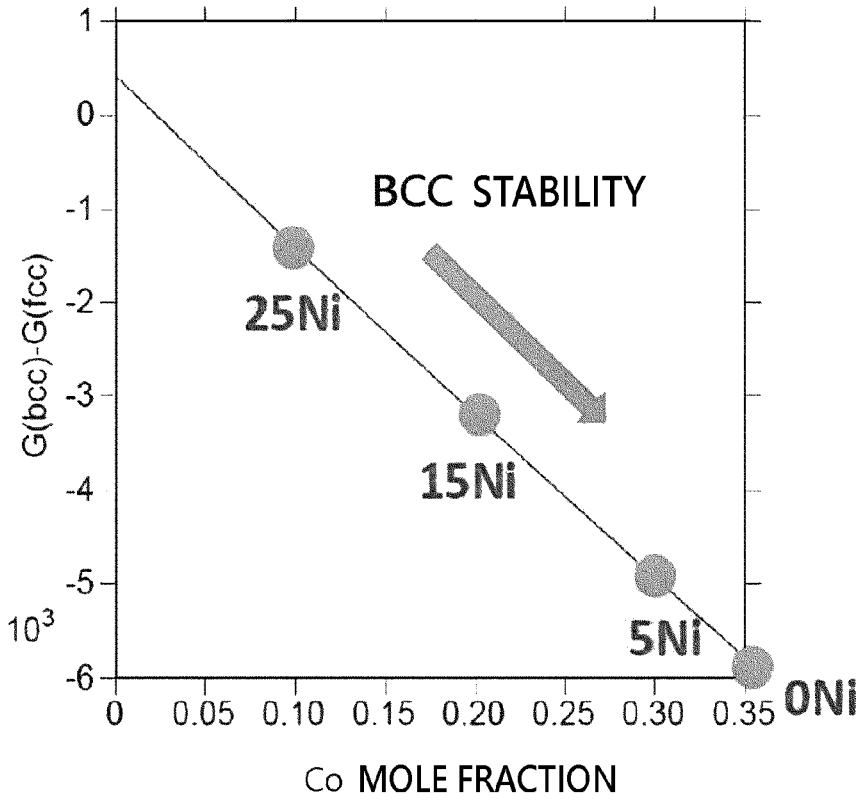

【FIG.3】
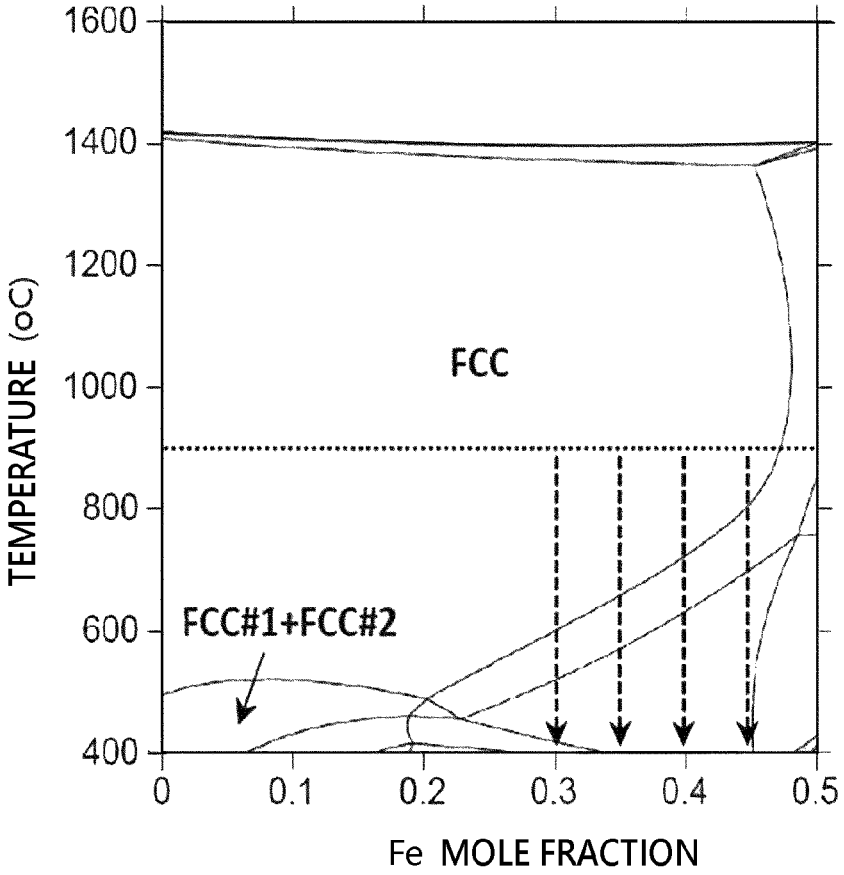

【FIG.4】
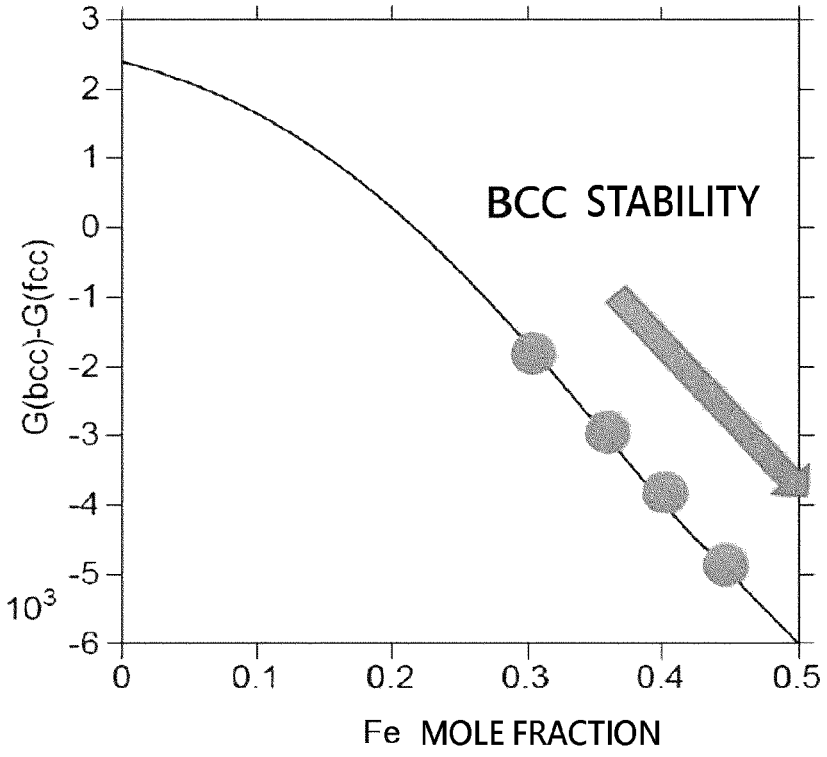

【FIG.5】
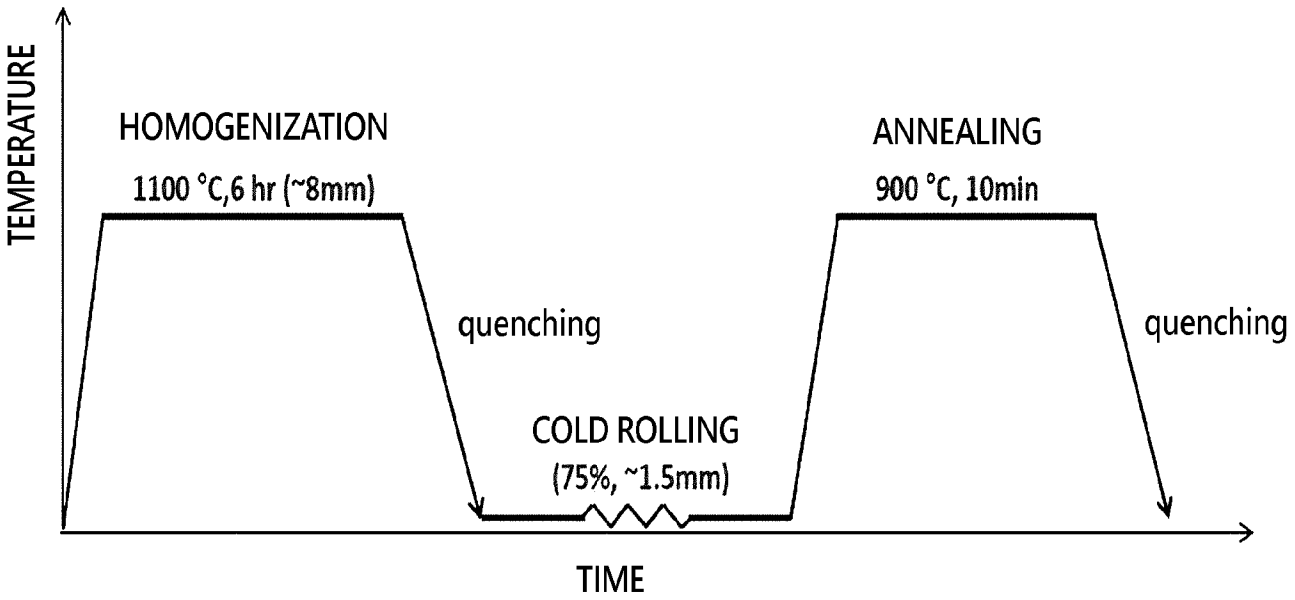

【FIG.6】
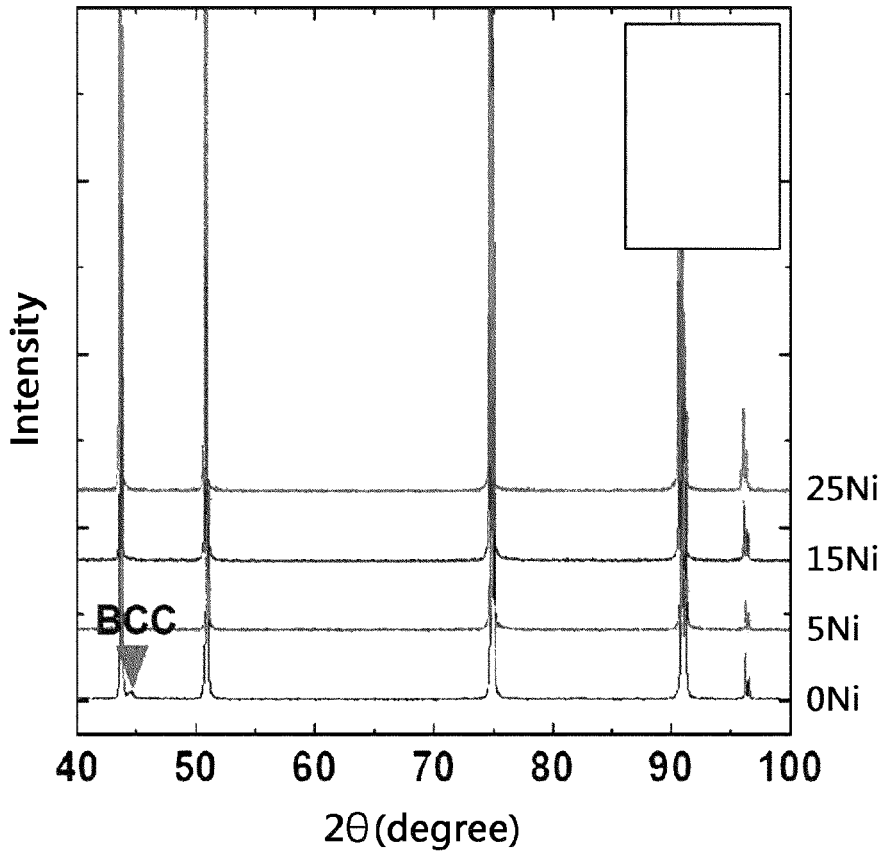

【FIG.7】
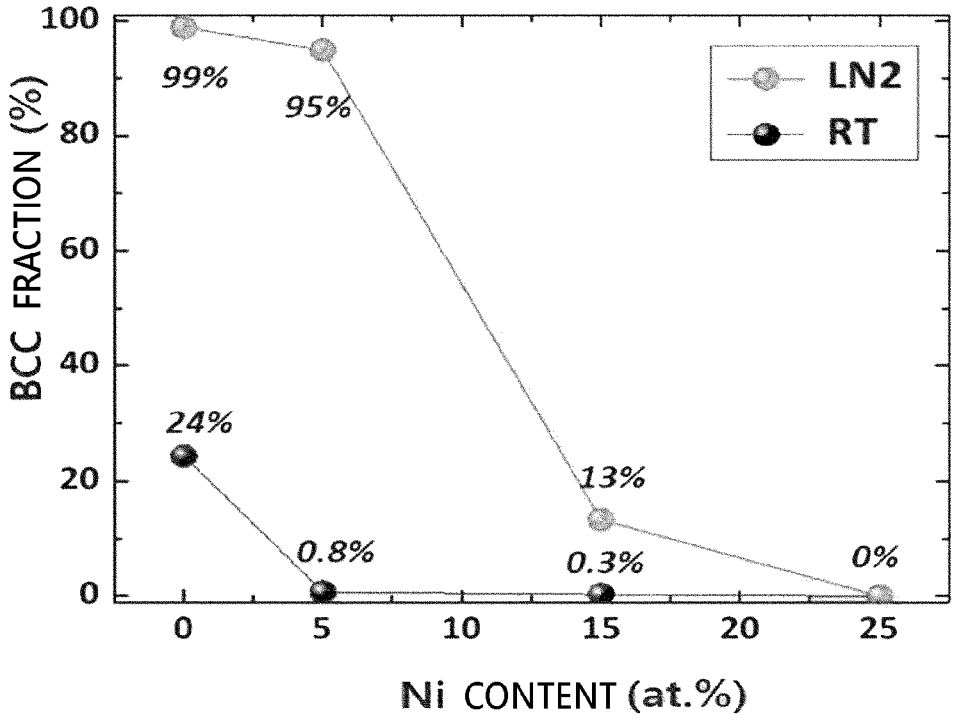

【FIG.8】
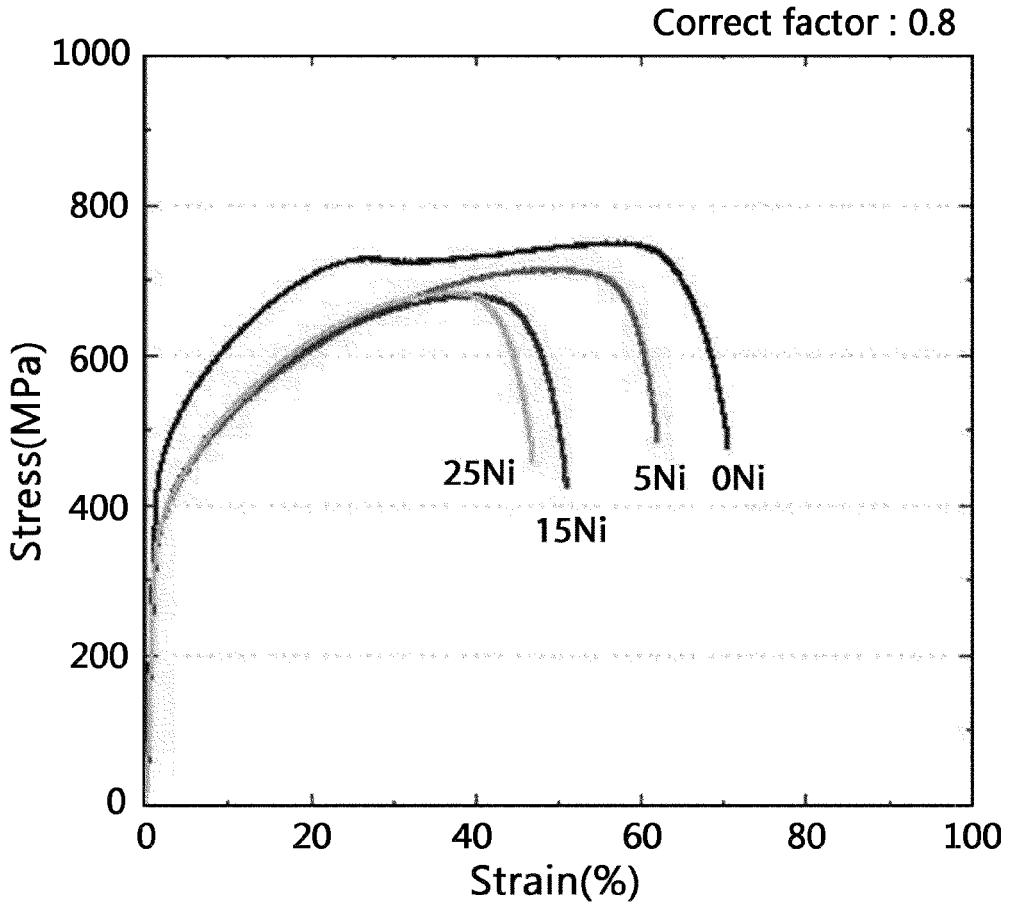

【FIG.9】
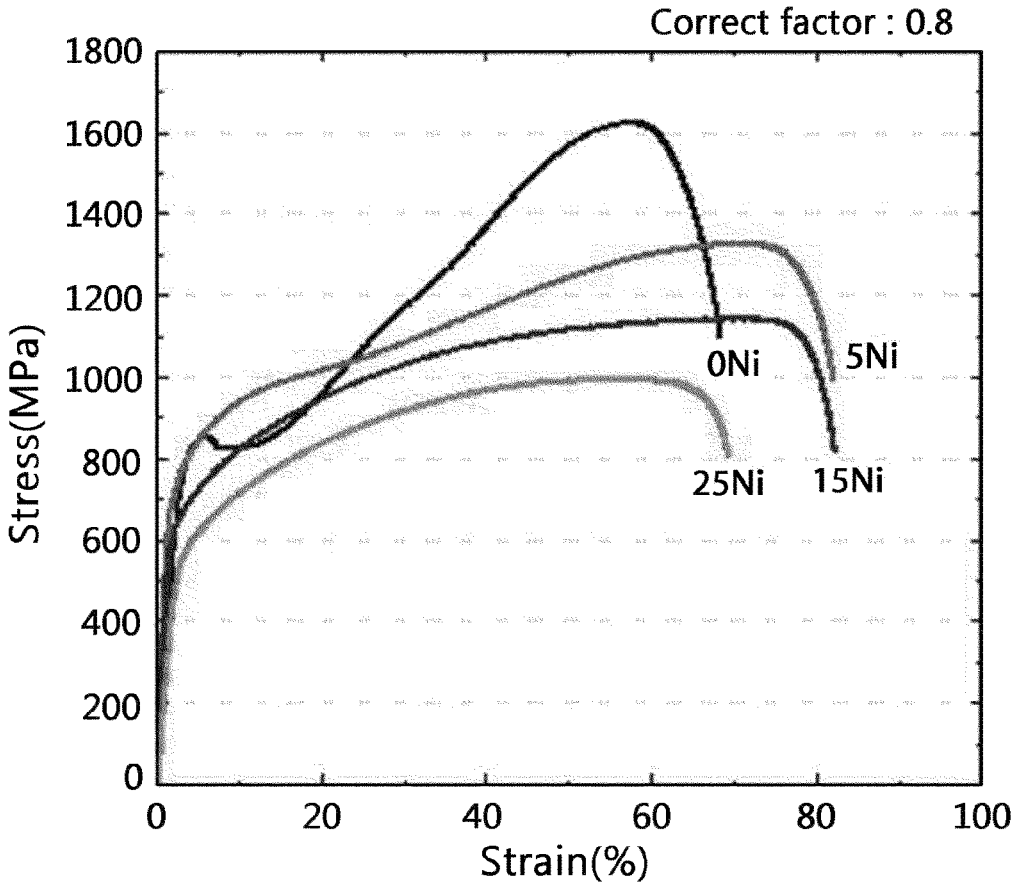

【FIG.10】
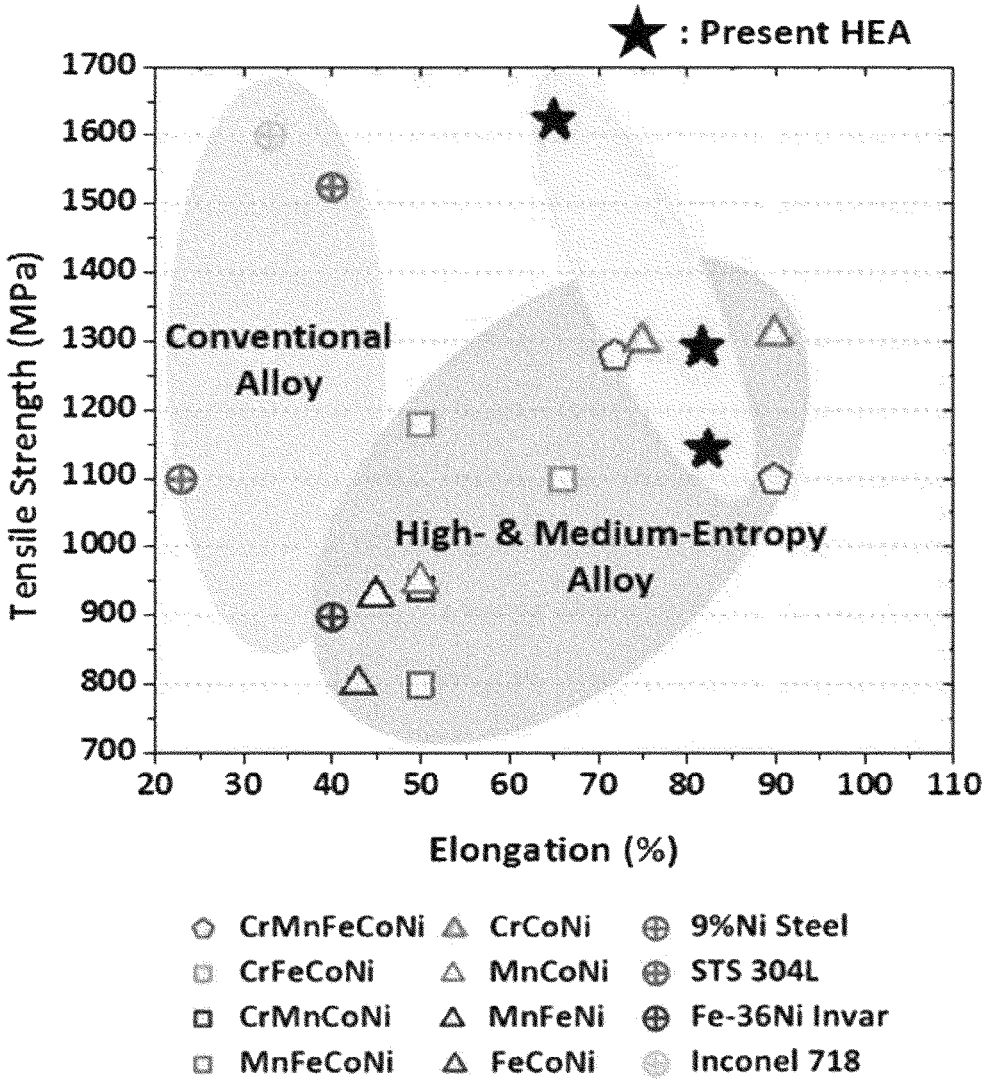

【FIG.11】
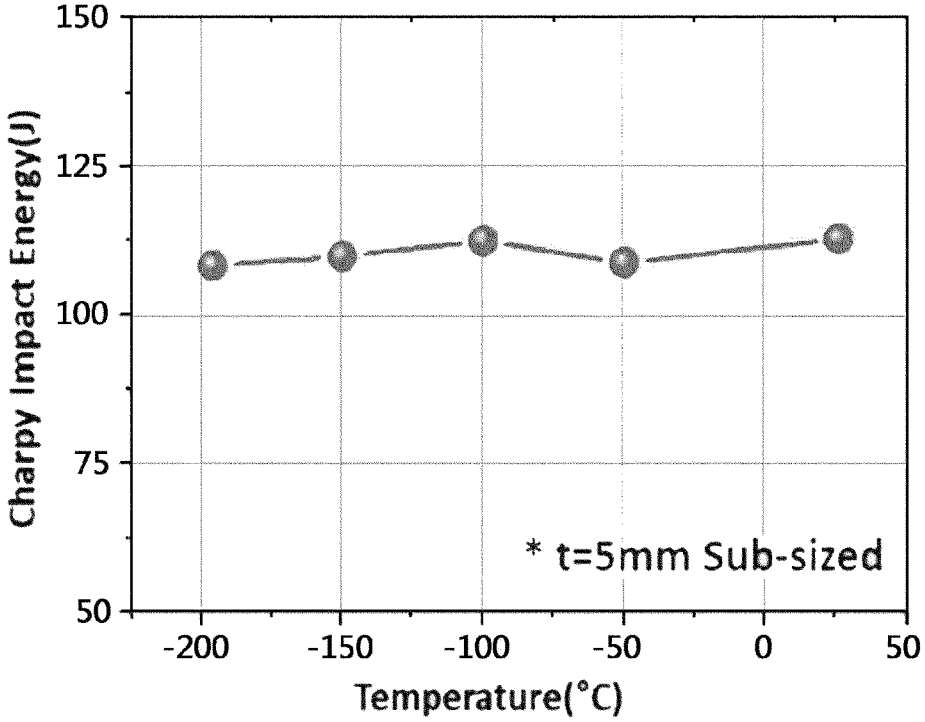

TRANSFORMATION-INDUCED PLASTICITY HIGH-ENTROPY ALLOY AND PREPARATION METHOD THEREOF

TECHNICAL FIELD

The present invention relates to a transformation-induced plasticity high-entropy alloy and preparation method thereof which can provide improved mechanical properties compared to those obtained by conventional methods, due to the phase transformation occurring when deformed at a cryogenic temperature.

BACKGROUND ART

High-entropy alloys (hereinafter, HEAs), which are multi-element alloys obtained by alloying similar proportions of five or more constituent elements without the main elements constituting the alloys (for example, general alloys such as steel, aluminum alloys, titanium alloys, etc.), are metallic materials that have a single-phase structure (e.g., face-centered cubic (FCC), body-centered cubic (BCC)) in which an intermetallic compound or intermediate phase is not formed due to high entropy of mixing within the alloys.

In particular, Co—Cr—Fe—Mn—Ni based HEAs have excellent cryogenic properties, high fracture toughness, and corrosion resistance, and are thus in the limelight as a material applicable to extreme environments.

An important factor in designing these HEAs is the composition ratio of the elements that constitute the alloy.

With regard to the composition ratio of HEAs, a typical HEA should consist of at least five major alloy elements, and the composition ratio of each alloy constituent element is defined as 5-35 at %, and if an element other than the main alloy constituent elements is added, the addition amount should be less than 5 at %.

However, in the recent years, the definition of HEAs has also been expanded, including the introduction of $Fe_{50}Mn_{50}Co_{10}Cr_{10}$ HEA, etc.

Meanwhile, it is known that the existing Co—Cr—Fe—Mn—Ni based HEA has excellent cryogenic properties through generation of a large number of deformation twins at a cryogenic temperature.

DISCLOSURE OF THE INVENTION

Technical Problem

An object of the present invention is to provide a transformation-induced plasticity high-entropy alloy, which mainly consists of FCC phase and are capable of achieving more improved mechanical properties at a cryogenic temperature (−196° C.), compared to previously reported HEAs having an FCC single-phase.

Technical Solution

To achieve the above object, an aspect of the present invention provides a transformation-induced plasticity high-entropy alloy, which contains 10-35 at % of Co, 3-15 at % of Cr, 3-15 at % of V, 35-48 at % of Fe, and 0-25 at % of Ni (exclusive of 25), and mainly consists of an FCC phase at room temperature, wherein transformation-induced plasticity, in which at least part of the FCC phase changes to a BCC phase, occurs at a cryogenic temperature (−196° C.)

Another aspect of the present invention provides a method for preparing a transformation-induced plasticity high-entropy alloy, the method including: a homogenization step, which includes heating and cooling for homogenizing the microstructure of a high-entropy alloy (HEA), which contains 10-35 at % of Co, 3-15 at % of Cr, 3-15 at % of V, 35-48 at % of Fe, and 0-25 at % of Ni (exclusive of 25); a step of rolling the homogenized HEA to a sheet having a predetermined thickness; and an annealing step, in which the rolled HEA is heated up to an FCC single-phase region, and then cooled at a cooling rate by which the FCC phase is able to be maintained.

Advantageous Effects

A high-entropy alloy (HEA) according to the present invention, as in the existing quinary HEAs, can provide a single-phase FCC structure by having a quaternary or quinary HEA composition that essentially contains Co, Cr, Fe, and V, and optionally containing Ni.

Additionally, unlike Co—Cr—Fe—Mn—Ni based HEAs, a HEA according to the present invention causes transformation-induced plasticity at a cryogenic temperature (−196° C.), and thus has a more excellent tensile strength, ductility, and fracture properties at a cryogenic temperature (−196° C.), than conventional single-phase HEAs.

BRIEF DESCRIPTION OF THE (DRAWINGS)

FIG. 1 shows phase equilibrium information on an alloy according to mole fractions of the alloy, as a cobalt (Co) content changes in a composition, where iron (Fe) is fixed at 45 at %, chromium (Cr) is fixed at 10 at %, and vanadium (V) is fixed at 10 at %, whereas cobalt (Co) is contained in an amount of X at % and nickel (Ni) is contained in an amount of 35-X at %.

FIG. 2 shows the stability of an FCC phase with respect to a BCC phase through thermodynamic calculations, as a cobalt (Co) content changes at 298 k in a composition where iron (Fe) is fixed at 45 at %, chromium (Cr) is fixed at 10 at %, and vanadium (V) is fixed at 10 at %, whereas cobalt (Co) is contained in an amount of X at % and nickel (Ni) is contained in an amount of 35-X at %.

FIG. 3 shows phase equilibrium information on an alloy according to mole fractions of the alloy as an iron (Fe) content changes in a composition, where chromium (Cr) is fixed at 10 at %, vanadium (V) is fixed at 10 at %, and cobalt (Co) is fixed at 30 at %, whereas iron (Fe) is contained in an amount of X at % and nickel (Ni) is contained in an amount of 50-X at %.

FIG. 4 shows the stability of an FCC phase with respect to a BCC phase through thermodynamic calculations, as an iron (Fe) content changes at 298 k in a composition where chromium (Cr) is fixed at 10 at %, vanadium (V) is fixed at 10 at %, and cobalt (Co) is fixed at 30 at %, whereas iron (Fe) is contained in an amount of X at % and nickel (Ni) is contained in an amount of 50-X at %.

FIG. 5 shows a preparation process of the HEAs according to Examples 1 to 3 and Comparative Example of the present invention.

FIG. 6 shows the results of XRD analysis of the HEAs according to Examples 1 to 3 and Comparative Example of the present invention.

FIG. 7 shows the measurement results of the fractions of transformation from an FCC phase to a BCC phase during a tensile test of the HEAs according to Examples 1 to 3 and Comparative Example of the present invention, at room temperature (RT) and a cryogenic temperature (LN2).

FIG. 8 shows the results of a tensile test of the HEAs according to Examples 1 to 3 and Comparative Example of the present invention, at room temperature (25° C.)

FIG. 9 shows the results of a tensile test of the HEAs according to Examples 1 to 3 and Comparative Example of the present invention, at a cryogenic temperature (−196° C.)

FIG. 10 shows the comparison results of the mechanical properties of the HEAs according to Examples 1 to and Comparative Example of the present invention, the conventional cryogenic materials, and existing HEAs, at a cryogenic temperature.

FIG. 11 shows the impact properties of the HEA according to Example 2 of the present invention.

MODE FOR CARRYING OUT THE INVENTION

Hereinafter, the present invention will be described in detail with regard to HEAs according to preferred embodiments of the present invention and a method thereof by referring to the accompanying drawings, but the present invention is not limited to these embodiments. Therefore, it will be apparent to those skilled in the art that various modifications and variations can be made in the present invention without departing from the spirit of the invention.

FIG. 1 shows phase equilibrium information on an alloy according to mole fractions of the alloy, as a cobalt (Co) content changes in a composition, where iron (Fe) is fixed at 45 at %, chromium (Cr) is fixed at 10 at %, and vanadium (V) is fixed at 10 at %, whereas cobalt (Co) is contained in an amount of X at % and nickel (Ni) is contained in an amount of 35-X at %.

As shown in FIG. 1, it was confirmed that when cobalt (Co) and nickel (Ni) were substituted in 45Fe-10Cr-10V (values are in unit of at %), it is confirmed that an FCC single-phase region is expanded as the cobalt (Co) content is decreased. This means that it is possible to obtain a HEA which has a microstructure stably and mainly consisting of an FCC phase at 900° C. or higher, when 45 at % of iron (Fe), 10 at % of chromium (Cr), 10 at % of vanadium (V), and at most 35 at % of cobalt (Co) are added while cobalt (Co) and nickel (Ni) are substituted.

FIG. 2 shows the stability of an FCC phase with respect to a BCC phase through thermodynamic calculations, as a cobalt (Co) content changes at 298 k in a composition where the iron (Fe) is fixed at 45 at %, the chromium (Cr) is fixed at 10 at %, and the vanadium (V) is fixed at 10 at %, whereas cobalt (Co) is contained in an amount of X at % and nickel (Ni) is contained in an amount of 35-X at %.

As shown in FIG. 2, when nickel (Ni) is substituted with cobalt (Co) in 45Fe-10Cr-10V (values are in unit of at %), the Gibbs free energy difference between the BCC phase and the FCC phase is increased as the molar ratio of cobalt (Co) is increased, and the stability of the BCC phase is increased. This means that when deformation is applied, such an increase acts as a driving force to cause a phase to be transformed from the FCC phase to the BCC phase.

FIG. 3 shows phase equilibrium information on an alloy according to mole fractions of the alloy as an iron (Fe) content changes in a composition, where the chromium (Cr) is fixed at 10 at %, the vanadium (V) is fixed at 10 at %, and the cobalt (Co) is fixed at 30 at %, whereas the iron (Fe) is contained in an amount of X at % and nickel (Ni) is contained in an amount of 50-X at %.

As shown in FIG. 3, when iron (Fe) and nickel (Ni) are substituted in 10Cr-10V-30Co (values are in unit of at %), it is confirmed that an FCC single-phase region is expanded as the iron (Fe) content is decreased, and it can be seen that the iron (Fe) content be preferably in an amount of 48 at % or less so as to maintain the FCC single-phase.

FIG. 4 shows the stability of an FCC phase with respect to a BCC phase through thermodynamic calculations, as an iron (Fe) content changes at 298 k in a composition where the chromium (Cr) is fixed at 10 at %, the vanadium (V) is fixed at 10 at %, and the cobalt (Co) is fixed at 30 at %, whereas the iron (Fe) is contained in an amount of X at % and nickel (Ni) is contained in an amount of 50-X at %.

As can be expected in FIG. 4, it is desirable that the iron (Fe) content be in an amount of 35 at % or more, in consideration of a driving force required for transformation from an FCC phase to a BCC phase.

Through the results shown in FIGS. 1 to 4, the present inventors have found that, by heat-treating an alloy having a composition with the above components and the content ranges thereof, a HEA, which mainly consists of an FCC phase and in which the Gibbs free energy of the body-center cubic structure (BCC) is smaller than that of the face-centered cubic structure (FCC), can be obtained, and such an alloy can significantly improve mechanical properties thereof at a cryogenic temperature because at least a part of the alloy is transformed from the FCC phase to the BCC phase when the alloy undergoes deformation at a cryogenic temperature (−196° C.), and thereby have completed the present invention.

The HEA according to the present invention is developed in accordance with the alloy designing principle described above, and is characterized in that the HEA essentially contains Co, Cr, Fe, and V, and optionally contains Ni, and mainly consists of an FCC phase, wherein transformation-induced plasticity from an FCC phase to a BCC phase occurs when plastic deformation is applied at a cryogenic temperature (−196° C.)

The HEA according to the present invention, may preferably contain 10-35 at % of Co, 3-15 at % of Cr, 3-15 at % of V, 35-48 at % of Fe, and 0-25 at % of Ni (exclusive of 25), and the remaining unavoidable impurities.

The reason why the content ranges of the alloy elements constituting the alloy are determined as described above is as follows.

When the Co content is less than 10 at % or greater than 35 at %, transformation-induced plasticity may not occur or a phase in which the FCC phase is dominant may not be obtained. Therefore, the Co content is preferably in a range of 10-35 at %, and more preferably 15-30 at %.

When the Cr content is less than 3 at %, the corrosion resistance is decreased; however, when the Cr content exceeds 15 at %, the price is increased. Therefore, the Cr content is preferably in a range of 3-15 at %, and more preferably 5-10 at %.

When the Ni content is equal to or greater than 25 at %, transformation-induced plasticity may not occur, and thus the Ni content is preferably less than 25 at %. When the Ni content is 0 at %, a complete FCC single-phase may not be obtained by the heat treatment at 900° C. Therefore, in order to achieve an FCC single-phase structure by the heat treatment at 900° C., the Ni content is more preferably in a range of 2.5-20 at % (exclusive of 20).

When the Fe content is less than 35 at % or greater than 48 at %, transformation-induced plasticity may not occur or a phase in which the FCC phase is dominant may not be obtained. Therefore, the Fe content is preferably in a range of 35-48 at %, and more preferably 40-45 at %.

When the V content is less than 3 at %, the solid-solution strengthening effect decreases; however, when the V content exceeds 15 at %, the price is increased. Therefore, the V content is preferably in a range of 3-15 at %, and more preferably 5-10 at %.

The unavoidable impurities are components other than the above-described alloy elements, which are raw materials or components unavoidably incorporated during the preparation process, and the impurities are included in an amount of 1 at % or less, preferably 0.1 at % or less, and more preferably 0.01 at % or less.

Additionally, the transformation-induced plasticity HEA according to the present invention is characterized by mainly consisting of an FCC phase, and the fraction of the FCC phase is preferably 95% or greater, and may consist of an FCC single-phase.

Additionally, the transformation-induced plasticity HEA according to the present invention is characterized in that phase transformation, in which at least part of the FCC phase before deformation changes to a BCC phase during a deformation process, occurs at a cryogenic temperature (−196° C.). Here, all of the FCC phases may be changed to BCC phases.

Additionally, the transformation-induced plasticity HEA according to the present invention may preferably have a tensile strength of 650 MPa or greater and has an elongation of 50% or greater, at room temperature (25° C.)

Additionally, the transformation-induced plasticity HEA according to the present invention may preferably have a tensile strength of 1,100 MPa or greater and has an elongation of 65% or greater, at a cryogenic temperature (−196° C.)

Additionally, in the transformation-induced plasticity HEA according to the present invention, a difference between an impact energy at room temperature (25° C.) and an impact energy at a cryogenic temperature (−196° C.) may be 10% or less.

Additionally, the transformation-induced plasticity HEA according to the present invention may preferably be prepared through the following steps of (a) to (c):

(a) a homogenization step, which includes heating and cooling for homogenizing the microstructure of a HEA, which contains 10-35 at % of Co, 3-15 at % of Cr, 3-15 at % of V, 35-48 at % of Fe, and 0-25 at % of Ni (exclusive of 25);

(b) a step of rolling the homogenized HEA to a sheet having a predetermined thickness; and (c) an annealing step, in which the rolled HEA is heated up to an FCC single-phase region, and then cooled at a cooling rate by which the FCC phase is able to be maintained.

In the homogenization step, when the temperature for homogenization treatment is lower than 1,000° C., the homogenization effect is insufficient; however, when the temperature for homogenization treatment is higher than 1,200° C., the heat treatment costs become excessive. Therefore, the temperature for homogenization treatment is preferably in a range of 1,000 to 1,200° C. When the time for homogenization treatment is less than 6 hours, the homogenization effect is insufficient; however, when the time for homogenization treatment exceeds 24 hours, the heat treatment cost becomes excessive. Therefore, the time for heat treatment is preferably in a range of 6 to 24 hours.

In the annealing, when the temperature for annealing treatment is lower than 800° C., it is not possible to achieve complete recrystallization; however, when the temperature for annealing treatment is higher than 1,000° C., grain coarsening becomes more severe. Therefore, the temperature for annealing treatment is preferably in a range of 800° C. to 1,000° C. When the time for annealing treatment is less than minutes, it is not possible to achieve complete recrystallization; however, when the time for annealing treatment is greater than 1 hour, the heat treatment cost becomes excessive. Therefore, the time for annealing treatment is preferably in a range of 3 minutes to 1 hour.

The cooling at steps (a) and (c) may be performed through water quenching, but is not particularly limited as long as a microstructure, which is required after each cooling treatment, can be achieved.

Examples

Preparation of HEAs

First, Co, Cr, Fe, Ni, and V metals having a purity of 99.9% or more were prepared. The metals thus prepared were weighed so as to have a mixing ratio shown in Table 1 below.

TABLE 1

| | Mixing Ratio of Raw Materials (at %) | | | | |
|---|---|---|---|---|---|
| Category | Co | Cr | V | Fe | Ni |
| Example1 | 35 | 10 | 10 | 45 | 0 |
| Example2 | 30 | 10 | 10 | 45 | 5 |
| Example3 | 20 | 10 | 10 | 45 | 15 |
| Comparative Example | 10 | 10 | 10 | 45 | 25 |

The raw material metals prepared at the above ratio were charged into a crucible, dissolved using vacuum induction melting equipment, and an alloy ingot in a rectangular parallelepiped shape (thickness: 8 mm, width: 35 mm, and length: 100 mm) was cast. The cast ingot (thickness: 8 mm) was subjected to homogenization heat treatment at a temperature of 1,100° C. for 6 hours, followed by water quenching, as shown in FIG. 5.

To remove oxides formed on the surface of the homogenized alloy, surface grinding was performed. The thickness of the ground ingot was 7 mm, and cold rolling was performed such that the thickness thereof changes from 7 mm to 1.5 mm.

Additionally, each of the cold-rolled alloy sheets was subjected to annealing treatment by heating at 900° C. for 10 minutes to maintain the FCC phase, followed by quenching to maintain the FCC phase at room temperature.

XRD Analysis of Microstructures

FIG. 6 shows the results of XRD measurement of the alloys at room temperature according to Examples 1 to 3 and Comparative Example prepared according to the process described above.

To minimize the phase transformation caused by the deformation of a sample during the grinding of the sample, the XRD measurement was performed after performing the grinding in the order of sandpaper Nos. 600, 800, 1200, and 2000, followed by electrolytic etching in 8% perchloric acid.

In FIG. 6, "0 Ni", "5 Ni", "15 Ni", and "25 Ni" indicate alloys according to Example 1, Example 2, Example 3, and Comparative Example, respectively. The same applies to the drawings following FIG. 6.

As observed in FIG. 6, it was confirmed that all the alloys according to Example 2, Example 3, and Comparative Example consist of FCC single-phases by XRD analysis.

On the other hand, it was shown that the alloy according to Example 1 mainly contained FCC phase and small amount of BCC phase. This is consistent with what is predicted from the equilibrium phase diagram of FIG. 1, and if the annealing temperature is higher than 900° C., the alloys can be prepared to have an FCC single-phase, as is the case with the alloys according to Examples 2 and 3.

Transformation-Induced Plasticity

FIG. 7 shows the fractions of a BCC phase in the microstructure after the tensile tests of the HEAs, which were prepared according to Examples 1 to 3 and Comparative Example at room temperature and at a cryogenic temperature (−196° C.), according to Ni content.

As shown in FIG. 7, in the case of Example 1, about 24% of phase transformation was achieved even when a tensile test performed at room temperature, whereas the amount of phase transformation was 0.8% in Example 2, very low to be 0.3% in Example 3, and 0% in Comparative Example.

In contrast, in the case of a tensile test performed at a cryogenic temperature (−196° C.), the amounts of phase transformation were 99% in Example 1, 95% in Example 2, 13% in Example 3, and 0% in Comparative Example, respectively. Further, it was confirmed that as the content of Ni became smaller, the phase transformation from an FCC phase to a BCC phase occurred more actively.

Results of Tensile Test

FIGS. 8 and 9 and Table 2 show the tensile test results of the alloys of Examples 1 to 3 and Comparative Example of the present invention at room temperature (25° C.) and a cryogenic temperature (−196° C.)

TABLE 2

| | Room Temperature | | | Cryogenic Temperature (−196° C.) | | |
|---|---|---|---|---|---|---|
| Category | Yield Strength (MPa) | Tensile Strength (MPa) | Elongation (%) | Yield Strength (MPa) | Tensile Strength (MPa) | Elongation (%) |
| Example 1 | 427 | 745 | 70.1 | 653 | 1623 | 65.0 |
| Example 2 | 348 | 714 | 62.0 | 601 | 1291 | 81.7 |
| Example 3 | 339 | 679 | 51.1 | 569 | 1142 | 82.3 |
| Comparative Example | 339 | 684 | 47.0 | 468 | 996 | 69.4 |

As shown in Table 2, the HEAs according to Examples 1 to 3 of the present invention, at room temperature, showed a yield strength of 339 MPa to 427 MPa, a tensile strength of 679 MPa to 745 MPa, and an elongation of 51.1% to 70.1%, and the HEA according to Comparative Example showed a yield strength of 339 MPa, a tensile strength of 684 MPa, and an elongation of 47%, thus showing no significant difference compared to those of Examples 1 to 3.

Meanwhile, the HEAs according to Examples 1 to 3 of the present invention, at a cryogenic temperature, showed a yield strength of 569 MPa to 653 MPa, a tensile strength of 1,142 MPa to 1,623 MPa, and an elongation of 65.0% to 82.3%, and the HEA according to Comparative Example showed a yield strength of 468 MPa, a tensile strength of 996 MPa, and an elongation of 69.4%, thus showing lower mechanical properties compared to those of Examples 1 to 3. Such a result demonstrates that the Comparative Example shows a significant difference compared to Example 3 that exhibits mechanical properties similar to those of Comparative Example at room temperature. These differences are assumed to be due to the transformation-induced plasticity.

Additionally, the HEA according to Example 1, at a cryogenic temperature, showed a high tensile strength of 1,623 MPa, and good elongation of 65.0%, which proves that the HEA according to Example 1 has high strength and good elongation. The HEAs of Examples 2 and 3, at a cryogenic temperature, showed a fairly high tensile strength of 1,142 MPa to 1,291 MPa, and very high elongation of 81.7% to 82.3%%, which proves that these HEAs have very high values in terms of tensile strength and elongation, respectively.

FIG. 10 shows the comparison results of the tensile strength and elongation at a cryogenic temperature of the HEAs (herein indicated as 'star' mark) according to Examples 1 to 3 of the present invention and other HEAs reported previously.

As shown in FIG. 10, the tensile strength and elongation of the HEAs according to Examples 1 to 3 of the present invention were extremely high thus exhibiting excellent characteristics compared to any conventional alloys or HEAs.

Results of Impact Test

FIG. 11 shows the results of the Charpy impact test performed under the conditions from room temperature to a cryogenic temperature. In the Charpy impact test, sub-sized samples with a thickness of 5 mm were used.

As shown in FIG. 11, the HEA according to Example 2 of the present invention showed constant values, that is, almost no difference between an impact energy value at room temperature and an impact energy value at a cryogenic temperature, and thus exhibited peculiar characteristics which could be hardly seen in existing materials, in which, generally, as the temperature decreases, the impact energy value decreases, and the BCC phase present at a cryogenic temperature causes the impact energy to be rapidly decreased.

This research was supported by Creative Materials Discovery Program through the National Research Foundation of Korea (NRF) funded by Ministry of Science and ICT (Project No.: NRF-2016M3D1A1023383, Project name: MULTI-PHYSICS FULL-SCALE Integrated Modeling Based Extreme Environment)

The invention claimed is:

1. A transformation-induced plasticity high-entropy alloy, consisting of 10-35 at % of Co, 3-15 at % of Cr, 3-15 at % of V, 35-48 at % of Fe, and 0-25 at % of Ni (exclusive of 25), wherein the transformation-induced plasticity high-entropy alloy has an FCC phase in which a fraction is 95% or more at room temperature, and wherein transformation-induced plasticity, in which at least part of the FCC phase changes to a BCC phase, occurs at a cryogenic temperature (−196° C.).

2. The transformation-induced plasticity high-entropy alloy of claim 1, wherein a Co content is in a range of 15-30 at %.

3. The transformation-induced plasticity high-entropy alloy of claim 1, wherein a Cr content is in a range of 5-10 at %.

4. The transformation-induced plasticity high-entropy alloy of claim 1, wherein a V content is in a range of 5-10 at %.

5. The transformation-induced plasticity high-entropy alloy of claim 1, wherein the Ni content is in a range of 2.5-20 at %.

6. The transformation-induced plasticity high-entropy alloy of claim 1, wherein a Fe content is in a range of 40-45 at %.

7. The transformation-induced plasticity high-entropy alloy according to claim 1, wherein the high-entropy alloy has a tensile strength of 650 MPa or greater and has elongation of 50% or greater, at room temperature (25° C.).

8. The transformation-induced plasticity high-entropy alloy according to claim 1, wherein the high-entropy alloy has a tensile strength of 1,100 MPa or greater and has an elongation of 65% or greater, at a cryogenic temperature (−196° C.).

9. The transformation-induced plasticity high-entropy alloy according to claim 1, wherein the high-entropy alloy has a difference in impact energy of 10% or less between room temperature and cryogenic temperature.

* * * * *